United States Patent [19]

Buckles

[11] Patent Number: 4,895,324

[45] Date of Patent: Jan. 23, 1990

[54] REUSABLE DERAILMENT DETECTION AND SIGNALING DEVICE

[76] Inventor: Don R. Buckles, 316 Tucker St., Erwin, Tenn. 37650

[21] Appl. No.: 296,081

[22] Filed: Jan. 12, 1989

[51] Int. Cl.[4] ..... B61L 3/00; B61L 1/20

[52] U.S. Cl. ..... 246/170; 246/246

[58] Field of Search ..... 246/169 R, 169.4, 170, 246/171, 172, 173, 246, 251, 259; 238/14.2, 14.4, 14.14, 34, 36, 43, 58, 312; 104/284, 242; 200/61.08; 429/114, 115

[56] References Cited

U.S. PATENT DOCUMENTS

| | | | |
|---|---|---|---|
| 3,902,690 | 9/1975 | Wanha | 246/170 X |
| 3,929,308 | 12/1975 | Armstrong et al. | 246/169 A |
| 4,133,506 | 1/1979 | Webster | 246/172 |

*Primary Examiner*—Andres Kashnikow
*Assistant Examiner*—Timothy Newholm

[57] ABSTRACT

A portable, reusable derailment signaling device has an elongated base, clamps on each end of the base adapted to affix the base firmly to the pedestals of spaced railroad tracks with the base positioned between the pedestals. Restraining shoulders are located on the base adjacent each end, and a cable is attached at its ends to the restraining shoulders and extends therebetween under substantial tension. One of the restraining shoulders has a movable segment to which the cable end is attached such that derailment force applied to the cable in a generally normal direction to its axis will cause the cable to deflect from its axis and cause the segment to move to actuate a transmission unit on the base that is electrically energizable to emit a radio signal. And an electrical power unit on the base is in electrical communication with the transmission unit and is actuable by movement of the segment to energize the transmission unit to emit a signal.

17 Claims, 6 Drawing Sheets

136
136
132
146
146
134
14
120

16
102
136
132
107
146
146
124
124
122
146
146
134
124
88
14
120

16
148
102
146
148

120
134
146
14
150
134
146

Fig. 10
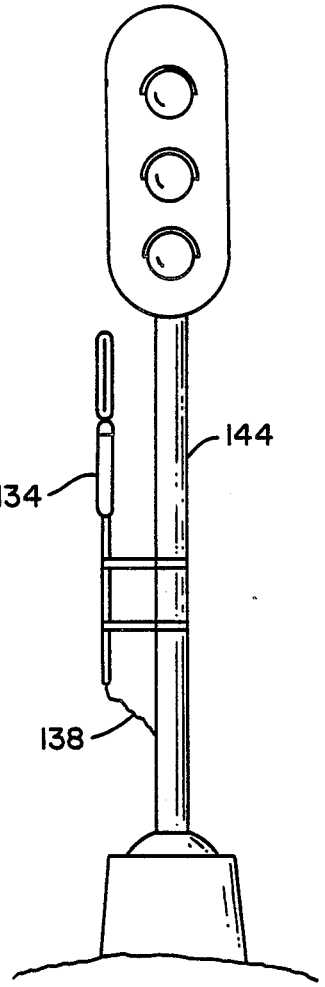
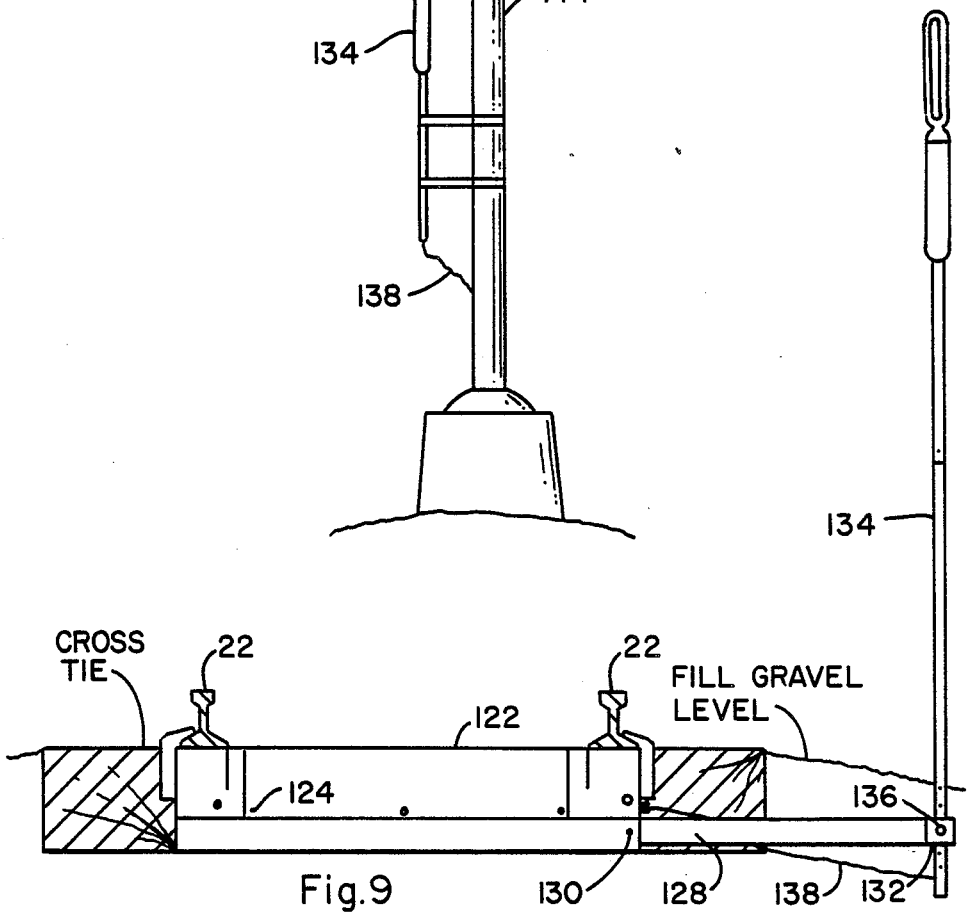
Fig.9

REUSABLE DERAILMENT DETECTION AND SIGNALING DEVICE

This invention concerns a derailment detection and signaling device which can be easily transported to a railroad track site and installed ready for use with a minimum of effort and essentially no need for highly technical electrical connection type operations. The device is essentially non-destructible and self-contained, requiring no elaborate hook-up or installation procedures, and is maintenance free, both mechanically and electrically for extremely long periods of time.

Heretofore, derailment detection and signaling devices have, for the most part, been of the one shot variety wherein the derailment forces intentionally destroy the sensing portions of the device. Also, elaborate external electrical wiring hook-ups are required. Such prior devices are disclosed in U.S. Pat. Nos. 3,822,369 and 4,133,506.

A principal object of the present invention therefore, is to provide a derailment detection and signaling device which is essentially non-destructible, easily transportable, can be installed anywhere along the tracks, and does not require any complex electrical hook-ups.

This and other objects hereinafter appearing have been attained in accordance with the present invention through the structure comprising a portable, reusable derailment signaling device comprising elongated base means, clamping means on each end of said base means adapted to affix said base means firmly to the pedestals of spaced railroad tracks with said base means positioned therebetween, retaining means on said base means adjacent each end thereof, cable means attached at its ends to said retaining means and extending therebetween under substantial tension, one of said retaining means having a movable segment to which the cable end is attached such that derailment force applied to said cable in a generally normal direction to its axis will cause said cable to deflect from its axis and cause said segment to move, transmission means on said base means electrically energizeable to emit a radio signal, and electrical power means on said base means in electrical communication with said transmission means and actuable by said movement of said segment to energize said transmission means to emit said signal.

In certain preferred embodiments:

the power means comprises battery means which is normally in an electrically neutral condition;

an elastomeric shroud means is provided on at least the upper surface portions of said cable means to protect the same from direct contact with the derailment force;

the said one retaining means comprises compression spring means held under substantial compressive force between said movable segment and a stationary portion of said base means;

each said clamping means comprises substantially horizontal shoulder means providing a slot for receiving a flange of a track pedestal;

either or both of said clamping means is adjustably mounted on said base means;

the said segment, said transmission means, and said power means are substantially sealed in separate chambers in said base means;

antenna connector means is provided on said base means in communication with said transmission means and adapted to electrically connect an antenna means thereto; and elongated cavity means is provided in said base means for slidably receiving and storing elongated antenna support means.

The invention and other preferred embodiments thereof will become further understood from the following description and drawings wherein:

FIG. 9 is a side elevation of the device in its installed, ready to use position;

FIG. 10 shows the antenna installed on a railroad signal tower at a location removed from the device.

Figure 1:
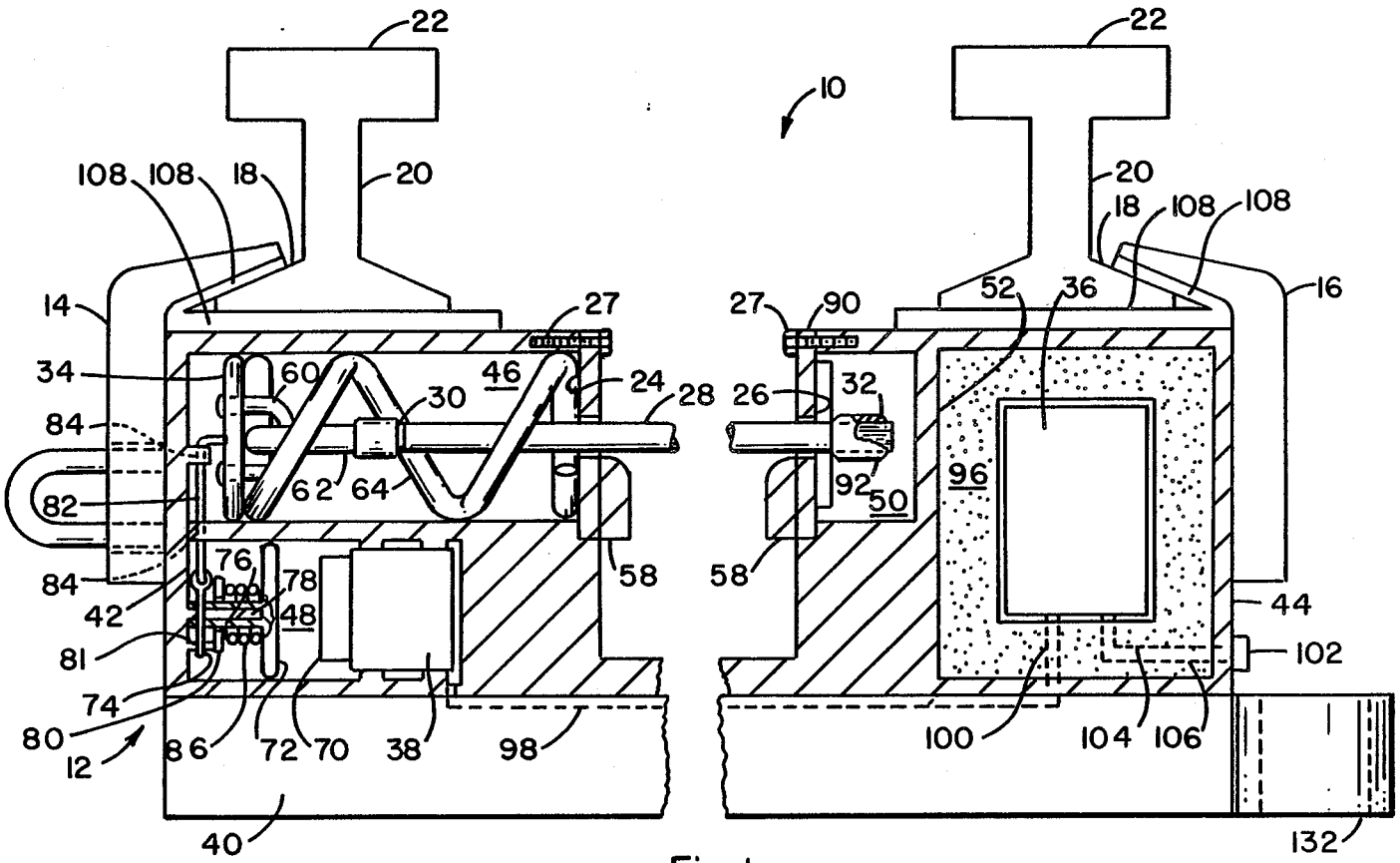
FIG. 1 is a longitudinal sectional view of the present device.

Referring to the drawings and with reference to the claims hereof the present signaling device generally designated 10 comprises elongated base means generally designated 12, clamping means 14 and 16 on the ends of the base means adapted to affix the base means firmly to the flanges 18 of the pedestals 20 of spaced railroad tracks 22 with the base means positioned therebetween, restraining means 24 and 26 on the base means adjacent the ends thereof, cable means 28 restrained at its ends 30 and 32 by said restraining means and extending therebetween under substantial tension, one of the cable ends being affixed to a movable segment 34 such that derailment force applied to the cable in a generally normal direction to its axis will cause the cable to deflect from its axis and cause segment 34 to move, transmission means 36 on the base means electrically energizeable to emit a radio signal, and electrical power means 38 on the base means in electrical communication with the transmission means and actuable by movement of the segment to energize the transmission means to emit the signal.

In more specific detail, the base means includes the lower segment 40 and the upper spaced housings 42 and 44. Housing 42 is formed to provide chambers 46 and 48, and housing 44 is formed to provide chambers 50 and 52. The facing restraining means or walls 24 and 26 of the housings are apertured to slidably receive cable 28 and each wall is preferably provided with a rounded pressure block 58 to prevent damage to the cable by sharp metal edges as it is being depressed or returned.

Referring further to chamber 46, the movable segment 34, preferably of circular configuration is provided with a U shaped hanger 60 on which a hook 62 is mounted, the hook being swedged, welded, brazed or the like to end 30 of the cable. A heavy compression spring 64 interposed under substantial compressive force between the restraining wall 24 and segment 34 provides the predetermined tensioning force to cable 28 such that casual vibrations or force applied to the cable will not trigger a derailment signal. Chamber 46 may be of any convenient crosssectional configuration, but preferably is square or rectangular such that the top 66 thereof provides adequate stabilizing surface for engagement with rail flange 18. Walls 24 and 26 which also serve as cover plates are each securable to their respective housings by long threaded bolts or screws such as 27 such that during assembly, the cable, retaining nuts, cover plates, spring, movable segment, and any other structure which needs to be placed in either chamber 46 or 50, can be pieced together with cable relaxed, forming an integrated subassembly. These subassemblies are then attached to their housing with said long bolts in the position shown. The tightening process of the two cover plates takes up the slack, and the resulting tension is easily achieved. Also, these cover plates provide easy access for servicing or replacing parts if necessary.

Figures 3, 4, 5, 6:
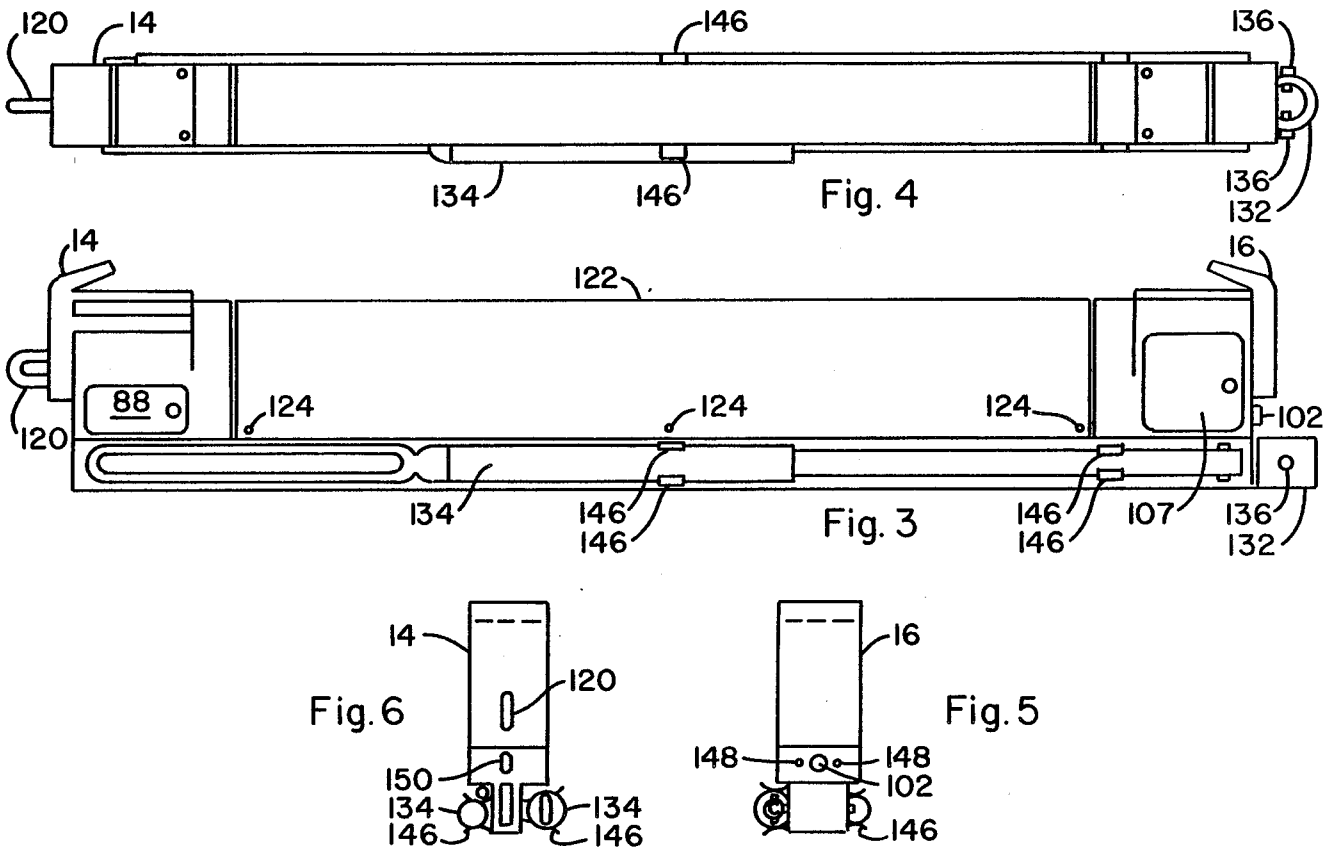
FIG. 3 is a side elevation of the device.
FIG. 4 is a top elevation of the device.
FIG. 5 is a right end elevation of the device.
FIG. 6 is a left end elevation of the device.
Figure 11:
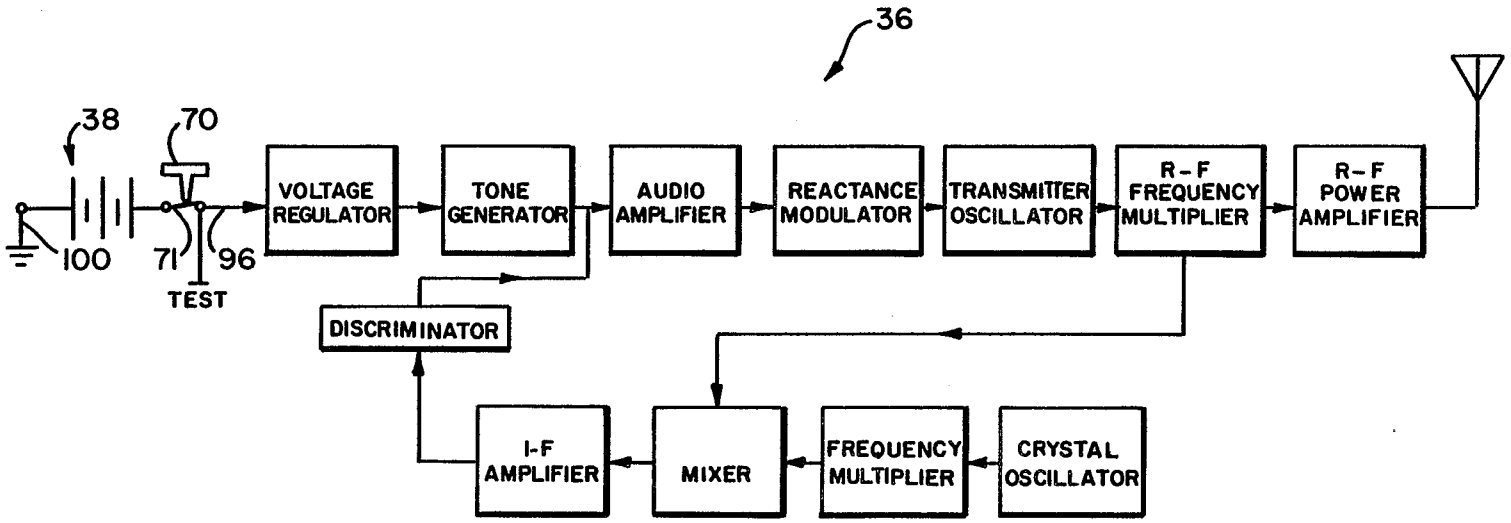
FIG. 11 is a schematic of a typical power source and signal transmitter combination useful in the present invention.

Positioned securely in chamber 48 is the power means 38 which is preferably a long-life battery, e.g., a thermal type battery, and preferably one which must be actuated by rupturing force applied against its actuator button 70. Such batteries are described in detail in the brochure entitled "Thermal Battery Operation and Construction" by CATALYST RESEARCH, a division of Mine Safety Appliance Company, Baltimore, Md., incorporated herein by reference. Alternative type power means comprises one or more long-life batteries 38 of conventional construction, wherein the actuator button 70 is simply a normally open (e.g. spring held) electrical push type switch such as shown at 71 in FIG. 11 in closed position on its electrical contacts in conventional manner and electrically connecting the batteries 38 to the signal generating or transmission means 36. The actuator button is suitably positioned to be struck by a plunger 72 which is normally held in cocked, retracted position by a release pin 74 slidably mounted in aligned apertures in the tubular plunger shaft 76 and a stationary post 78 projecting from the housing and slidably mounted in the bore of the plunger shaft. Pin 74 is connected by a flexible linkage wire or cable 82 passing through and freely slidable in one or more bearing apertures 84, to movable segment 34. Washer 80 through which tube 76 slides, is provided with pedestal legs 81 bearing against the inner wall of housing 42 and provides a stop against which spring 86 is compressed. Legs 81 are spaced such that they do not interfere with the sliding action of pin 74. Other equivalent stop means may, of course, be employed. Alternatively, shaft 78 could be stationary and tubular and movable tube 76 could be a solid shaft sliding therein. The stop washer 80 could then be welded to the stationary tube, thus eliminating need for the pedestal arrangement. Compression spring 86 provides the propelling force to the plunger, upon retraction of the pin 74 through movement of segment 34, necessary to depress button 70 which is part of a percussion primer device and thereby acutate the power means 38. A hermetically sealable and lockable cover plate 88 shown in FIG. 3 is provided to allow access to chamber 48 to install or replace the power means 38 after use or after some predetermined maintenance period, or to recock the plunger 72 with pin 74.

End 32 of cable 28 is mounted through retaining wall 26 and preferably is provided with a snug fitting washer 90 prior to affixing retaining nut 92 thereto by swedging, screwing, welding or the like onto the cable.

Positioned in cavity 52 within a shock absorbing cushion 96 of cellular material, foamed plastic, sponge or the like, is the signal generating or transmission means 36 adapted by electrical switching to be placed in electrical communication with the power means 38 by, for example, electrical wire 98 and ground lead 100, and with antenna connector 102 by electrical leads 104 and 106. The transmission means 36 can be any type of electrical or electronic signaling device such as are well known in the art. A hermetically sealable and lockable access cover plate 107 is provided to protect transmitter 36 and to provide installation or maintenance access therefor.

Figure 7:
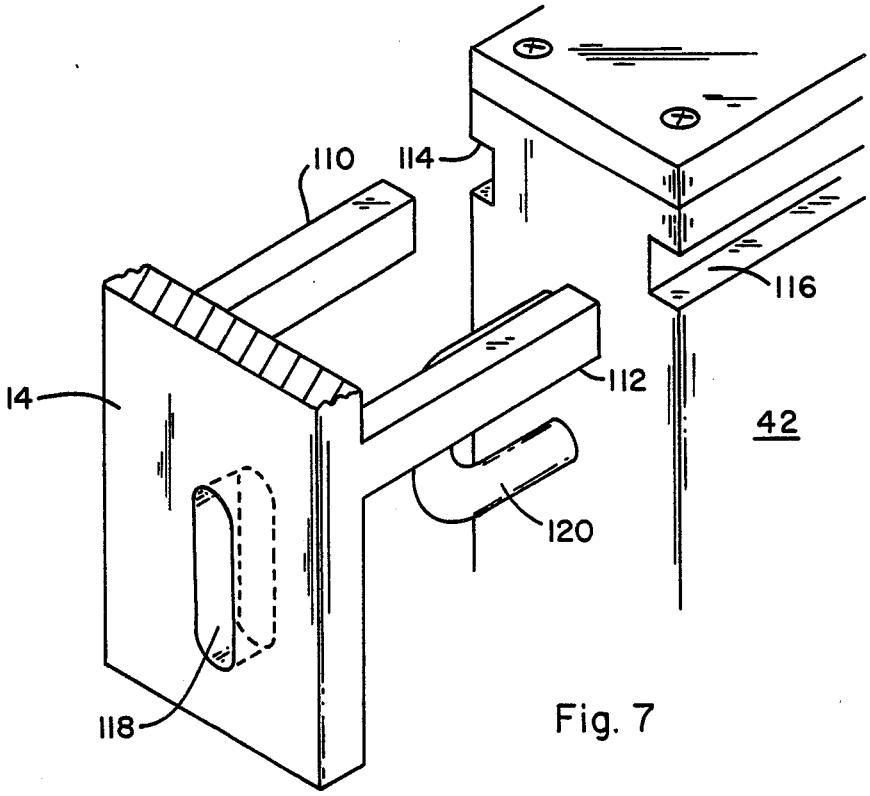
FIG. 7 is an isometric view of the left end of the device.

The clamping means 14 and 16 are preferably of hardened steel and provided with tough elastomeric vibration damper pads 108 cemented or mechanically secured thereto. These pads greatly assist in gripping the tracks and in reducing the chances of vibrational damage to the electrical components and premature triggering of the transmitter. Clamp 16 is preferably permanently affixed to housing 44 and may be formed integrally therewith. The preferred structure for clamp 14 is more clearly shown in FIG. 7 as being provided with stabilizing bars 110 and 112 which slidably mount in slots 114 and 116 respectively in housing 42. An aperture 118 is provided in the clamp to slidably receive a U shaped hanger 120 affixed to housing 42. This hanger is adapted to extend through aperture 118 a sufficient distance to allow a padlock to be placed therethrough to prevent unauthorized removal of the device from the tracks. It is noted that hanger 120 is preferably of a sufficient length to extend far enough through aperture 118 to accommodate a lock even where the track gauge is wider than normal, e.g., up to about one inch or so.

Figure 2:
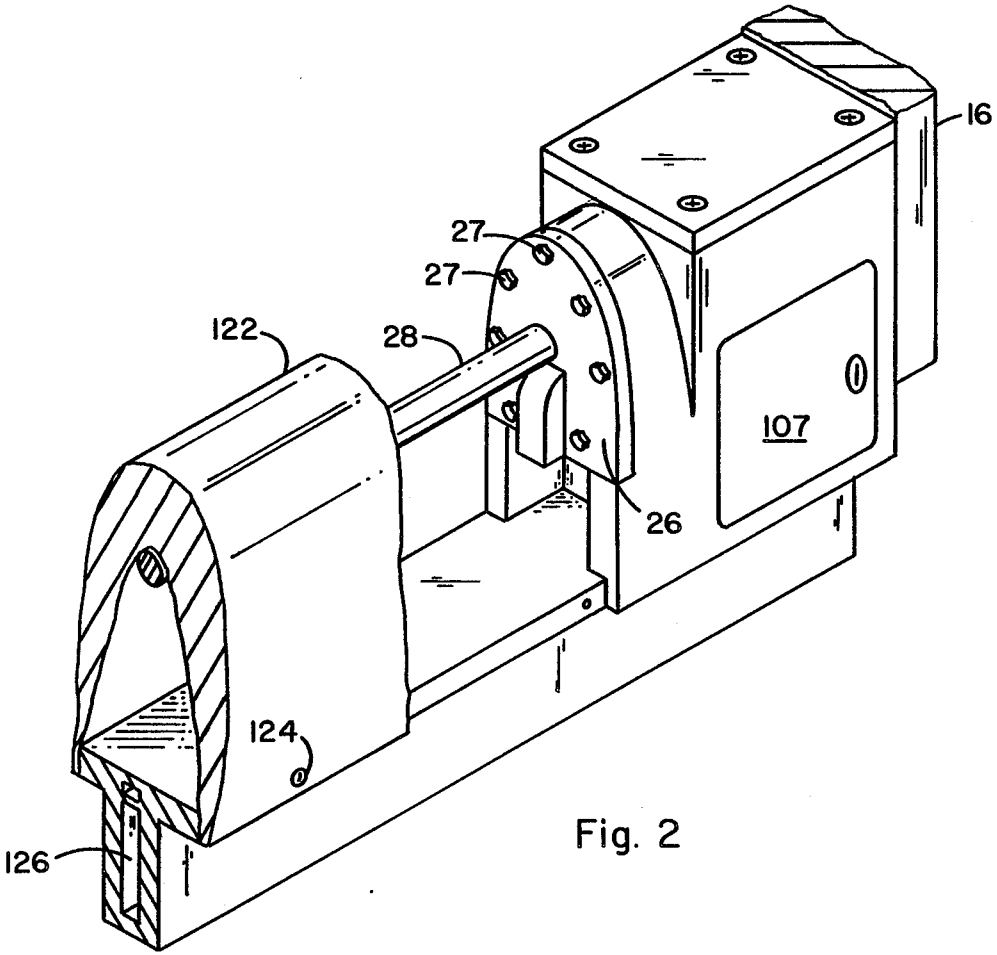
FIG. 2 is an isometric view of a portion of the device.

Referring to FIGS. 2 and 9, a heavy, tough elastomeric shroud 122 is positioned over cable 28 and held in position on the base by screws 124 or the like. This shroud protects the cable from metal-to-metal contact during a derailment which otherwise might destroy or at least severely kink or abrade the cable.

In a preferred embodiment, the base 40 is formed generally to a T shape and provided with a longitudinally extending cavity 126. An elongated antenna support 128 is slidably mounted in this cavity and may be extended as shown in FIG. 9 and locked in position on the base by suitable means such as bolt or pin 130. The outer end of this support is provided with a bushing 132 for receiving an antenna 134. Suitable means such as bolts or pins 136 secures this antenna in place in the bushing. Suitable leads 138 extend from the antenna and plug into connector 102.

Figure 8:
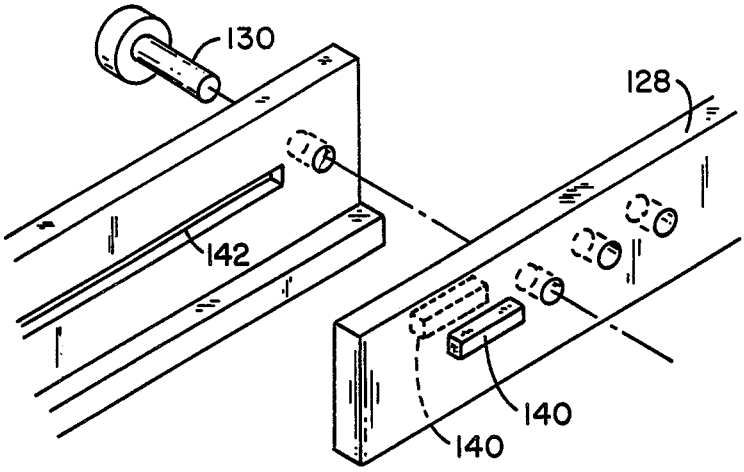
FIG. 8 is an exploded view of a portion of the antenna support and cooperating base structure.

As shown in FIG. 8, support 128 may be provided with stop projections 140 or the like slidable in grooves 142 in the side walls which form cavity 126. These stops prevent inopportune withdrawal of the support from the cavity. The antenna may, of course, be erected at some location removed from the device such as on the signal mast 144 shown in FIG. 10. As shown in FIGS. 3–6, the antenna sections or extensions are conveniently stored in clip type or other equivalent holders such as 146 on the lower sides of the base during transportation or the like. Suitable test terminals such as 148 shown in FIG. 5 may be provided to electrically connect the transmitter 36 to an external power source for periodic maintenance testing of the transmitter. It is also preferred to provide a sight glass 150 such as shown in FIG. 6 to visually ascertain upon maintenance inspection that the trigger pin 74 has not accidentally been pulled and the power source 38 thus spent.

The invention has been described in detail with particular reference to preferred embodiments thereof, but it will be understood that variations and modifications will be effected within the spirit and scope of the invention.

I claim:

1. A portable, reusable derailment signaling device comprising elongated base means, clamping means on each end of said base means adapted to affix said base means firmly to the pedestals of spaced railroad tracks with said base means positioned therebetween, restraining means on said base means adjacent each end thereof, cable means attached at each of two respective ends to said restraining means and extending therebetween under substantial tension, one of said restraining means having a movable segment to which the cable end is attached such that derailment force applied to said cable in a generally normal direction to its axis will cause said cable to deflect from its axis and cause said segment to move, transmission means on said base means electrically energizeable to emit a radio signal, and electrical power means on said base means in electrical communication with said transmission means and actuable by said movement of said segment to energize said transmission means to emit said signal.

2. The device of claim 1 wherein said electrical power means comprises battery means which is normally in an electrically open condition.

3. The device of claim 2 wherein said battery means is electrically activated by the mixing of normally isolated materials through movement of said segment.

4. The device of claim 3 wherein said mixing is initiated by physical impact on said battery means, wherein the impact is provided by means of spring forced plunger means normally locked in passive position by a trigger mechanism, said mechanism being connected to said segment and actuable thereby to release said plunger means from its passive position.

5. The device of claim 4 wherein said trigger mechanism comprises a locking pin slidably mounted through adjacent portions of said plunger means and base means in its locking position, said pin being connected by linkage means to said segment, said linkage means being operable to pull said pin from its locking position in response to movement of said segment.

6. The device of claim 1 wherein elastomeric shroud means is provided on at least the upper surface portions of said cable means to protect the same from direct contact with the derailment force.

7. The device of claim 1 wherein said one restraining means comprises compression spring means held under substantial compressive force between said movable segment and a stationary portion of said base means.

8. The device of claim 1 wherein each said clamping means comprises substantially horizontal shoulder means providing a slot for receiving a flange of the respective track pedestal.

9. The device of claim 8 wherein said shoulder means are provided with elastomeric cushion means.

10. The device of claim 8 wherein said clamping means are oriented such that the slots receive the outer flanges of the track pedestals and wherein one of said clamping means is adjustably mounted on said base means for movement with respect to the adjacent outer flange generally parallel to the plane of the tracks.

11. The device of claim 10 wherein cooperating locking means are provided on said adjustable clamping means and said base means for securing said device in an operable position on said tracks.

12. The device of claim 1 wherein at least one of of said clamping means is adjustably mounted on said base means.

13. The device of claim 1 wherein said movable segment, said transmission means, and said electrical power means are enclosed in substantially sealed separate chambers in said base means.

14. The device of claim 13 wherein said movable segment and said power means are chambered at one end of said base means, and said transmission means is chambered at the other end of said base means.

15. The device of claim 14 wherein said transmission means is encased in a protective foamed lining.

16. The device of claim 1 wherein antenna connector means is provided on said base means in communication with said transmission means and adapted to electrically connect an antenna means thereto.

17. The device of claim 16 wherein elongated cavity means is provided in said base means for slidable receiving and storing elongated antenna support means.

* * * * *